United States Patent [19]

Wooley

[11] 4,443,211

[45] Apr. 17, 1984

[54] ENVELOPE ASSEMBLY APPARATUS

[75] Inventor: Robert E. Wooley, Charlotte, N.C.

[73] Assignee: National Service Industries, Inc., Atlanta, Ga.

[21] Appl. No.: 323,961

[22] Filed: Nov. 19, 1981

[51] Int. Cl.[3] ..... B31B 1/16; B31B 1/74

[52] U.S. Cl. ..... 493/188; 493/210; 493/224; 493/236

[58] Field of Search ..... 493/224, 223, 222, 917, 493/919, 187, 188, 210, 228, 245, 264–266, 235, 236

[56] References Cited

U.S. PATENT DOCUMENTS

| | | | |
|---|---|---|---|
| 2,986,976 | 6/1961 | Novick | 493/919 X |
| 3,868,894 | 3/1975 | Watson | 493/188 |
| 4,360,355 | 11/1982 | Suominen | 493/224 X |

*Primary Examiner*—James F. Coan

*Attorney, Agent, or Firm*—Mason, Fenwick & Lawrence

[57] ABSTRACT

An envelope forming machine includes frame means supporting envelope blank feed means for feeding envelope blanks from an upstream end serially past aligner means, a printer transfer roller positioned adjacently above selectively operable printer means, scoring means and folding means to an envelope delivery station, with a release paper patch applying means being positioned above the transfer roller to apply a patch of release paper to adhesive on a flap of each envelope as each envelope flap passes over the printer transfer roller which serves as a backup roller against the flap during the application of the patch of release paper to the envelope flap.

7 Claims, 5 Drawing Figures

ENVELOPE ASSEMBLY APPARATUS

BACKGROUND OF THE INVENTION

The present invention is in the field of envelope forming machines and is more particularly directed to an envelope forming machine for forming open end envelopes having an end flap to which contact adhesive is applied with a patch release paper being applied over the adhesive to protect and preserve the adhesive until such time as the envelope is ready to use.

Previously known envelope machines of the type manufactured by F. L. Smithe Machine Company, Inc. of New York, N.Y., employ a frame supported envelope blank feed means for feeding envelope blanks through a series of work stations in which operations such as scoring, folding, and the like are performed on the envelope blanks to form the complete envelope which is then discharged at an envelope delivery station at the downstream end of the machine. The envelope blanks are received from an infeed conveyor and pass in succession past a blank re-feeder at the upstream of the machine, a first aligner, a printing station which includes a selectively operable transfer roller which when operated serves to direct envelope blanks downwardly into printing means positioned below the normal feed path for applying desired indicia to the envelope blank which is then returned to the normal feed path. The partially formed envelope then moves past a second aligner and side flap score and fold station and is then shifted laterally through end flap score and fold means and thence to an envelope delivery station from which the completed envelopes are discharged.

When conventional apparatus of the foregoing type is used for forming open end envelopes having an open end flap to which adhesive and an overlying patch of release paper are applied, the adhesive is applied to the envelope blanks at a station at the upstream end of the infeed conveyor with the blanks then moving the length of the conveyor from which they are fed past the blank re-feeder, the first aligner, the printing station, the second aligner, a release paper patch applying apparatus positioned and located between the second aligner and the side flap score and fold station. The adhesive on the end flap is consequently unprotected as it moves along the feed path of the machine over the printing apparatus so that the adhesive sometimes contacts parts of the machine or other envelopes to create waste and possible jamming of the machine along with an undesirable and unsightly accumulation of adhesive on parts of the machine. In order to minimize the accumulation of adhesive on the machine, it has consequently been the practice in the industry to apply powder in the form of cornstarch over the machine surfaces most likely to be brought into contact with the adhesive so as to create a dusty and somewhat unsightly operation. Moreover, in order to minimize the amount of wastage, it is necessary to operate the machine at a relatively slower speed than would otherwise be possible.

Therefore, it is the primary object of the present invention to provide a new and improved envelope forming machine for forming open end envelopes having an end flap coated with contact adhesive and a protective release paper patch applied over the adhesive.

SUMMARY OF THE INVENTION

Achievement of the foregoing object is enabled by the preferred embodiment of the invention by means of a modification of the prior known above-discussed envelope forming machine to permit usage of the transfer roller at the printing station as a back-up roller for the application of a release paper patch to the adhesive on each envelope end flap as each end flap passes over the transfer roller. As a consequence, the end flaps are provided with the release paper over the adhesive to protect the adhesive on the flaps at a location nearer the upstream end of the machine prior to any folding or scoring of the envelope blanks so as to eliminate movement of the unprotected adhesive coated end flaps through a substantial portion of the feed path of the machine. In other words, the end flaps are provided with protection at the upstream end of the machine so as to reduce the loss of adhesive, engagement of the adhesive with the machine parts and adjacent envelopes and consequent wastage previously encountered in the prior-known machine. This result is achieved without any modification of the printing station apparatus, the transfer roller of which is used in the application of the release paper patches while still retaining its original function of transferring envelope blanks into the printing structure per se.

A better understanding of the invention will be achieved when the following detailed description of the preferred embodiment is described in conjunction with the appended drawings in which like reference numerals are employed for the same parts as illustrated in the different figures.

DESCRIPTION OF THE PREFERRED EMBODIMENT

Figures 1, 2:
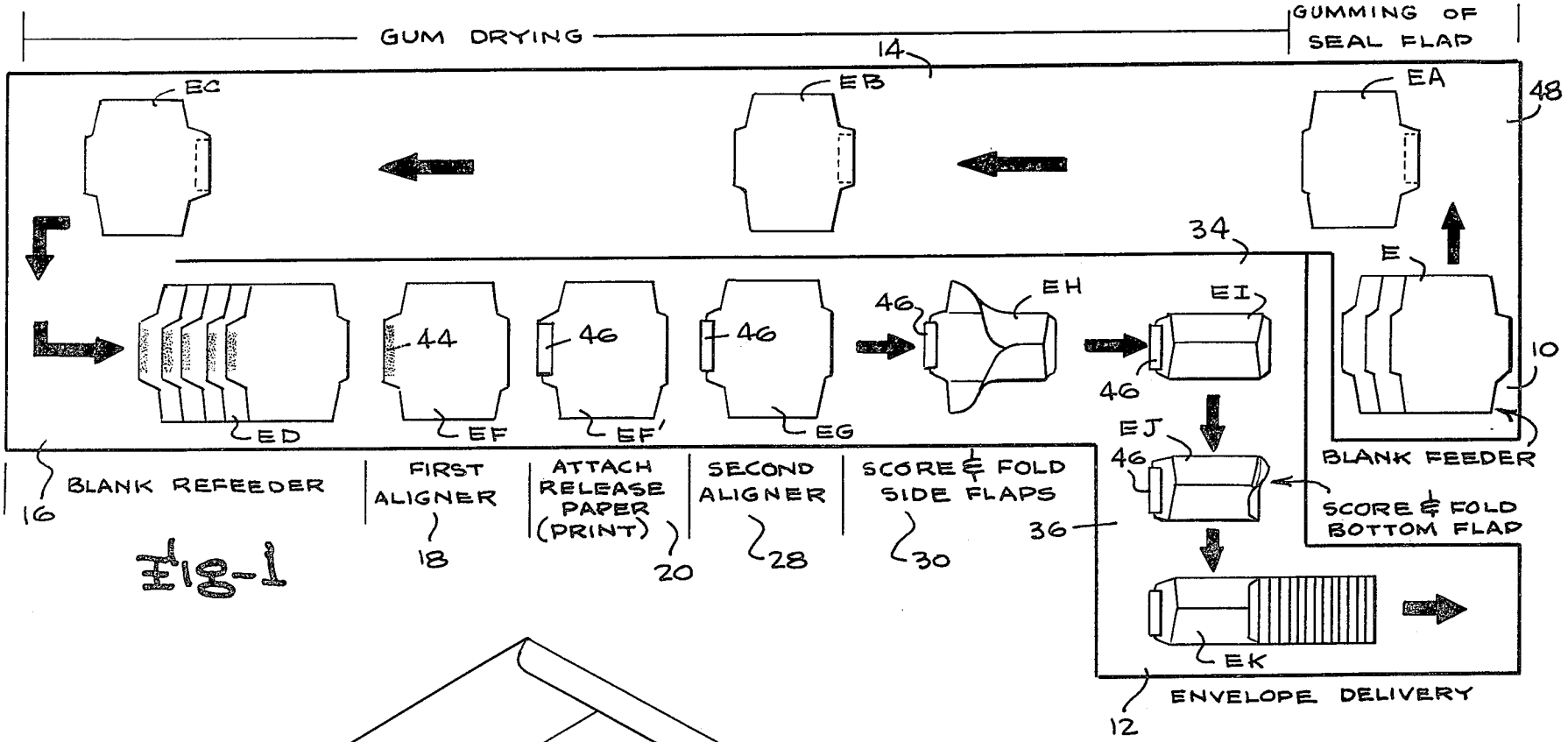
FIG. 1 is a plan view of the preferred embodiment illustrating the various work stations through which the envelope blanks are fed and subjected to various envelope fabrication procedures in both prior conventional machines and the preferred embodiment.
FIG. 2 is a perspective view of a finished envelope formed by the inventive apparatus.

Attention is initially invited to FIG. 1 of the drawings which illustrates the flow path of envelope blanks through an envelope forming machine of the conventional type manufactured by F. L. Smithe Machine Co., Inc. which includes a series of work stations through which envelope blanks E are fed from a blank feeder station 10 past a series of work stations to an envelope delivery station 12. The work performed on the envelopes depends upon the nature of the envelope being formed.

Figure 3:
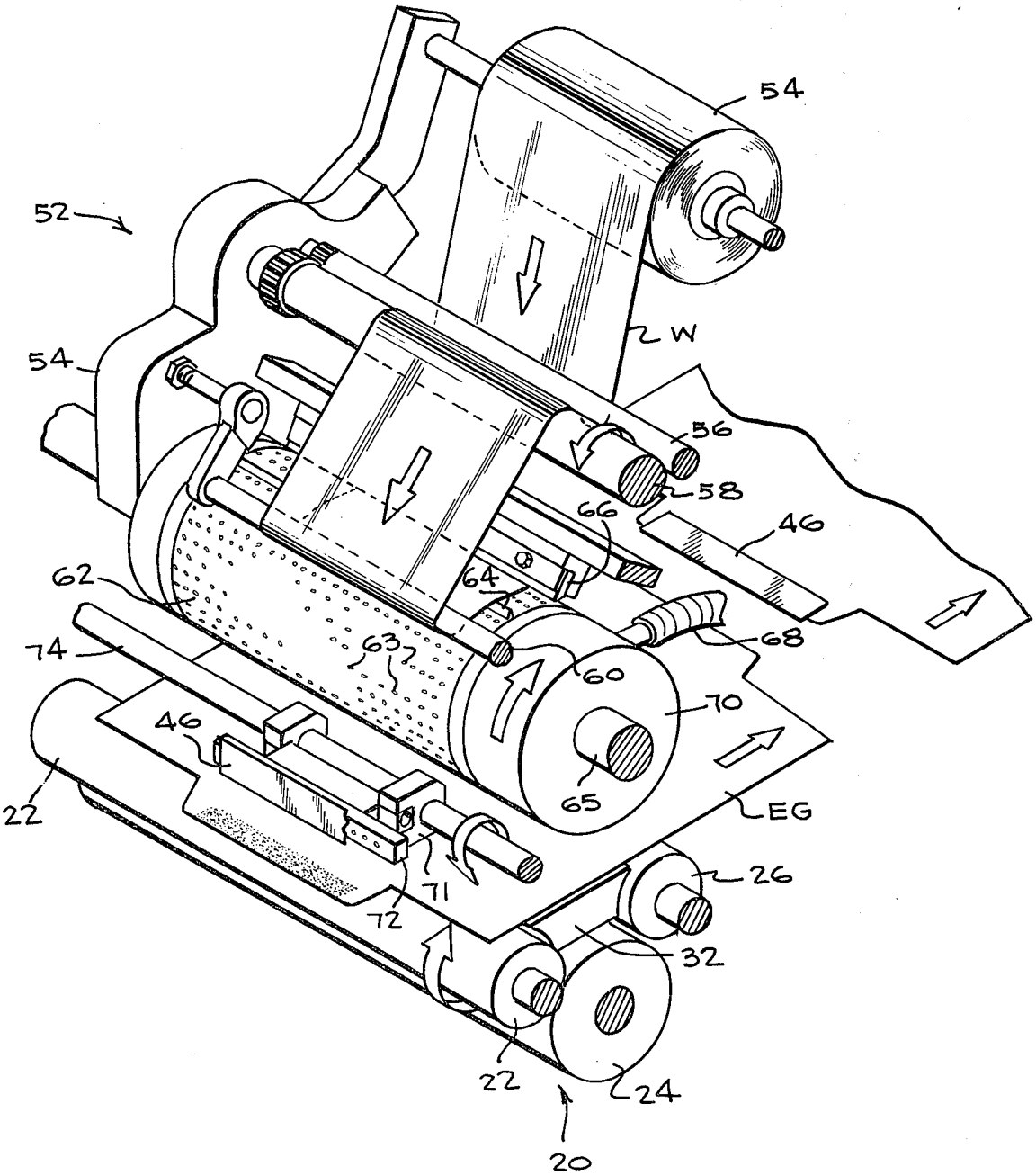
FIG. 3 is a perspective view of the release paper patch applying means and an associated portion of the printing station apparatus.

The conventional apparatus includes an infeed conveyor generally designated 14 for receiving the blanks E and conveying them to a blank re-feeder station 16 from which the laterally shifted envelope blanks are moved from the conveyor 14 and inverted with the blanks being positioned in a lapped arrangement as exemplified by blanks ED as shown. The envelope blanks move from the blank re-feeder station 16 to a first aligner station 18 in which the blanks are separated from the trailing blanks as exemplified by blanks EF and properly aligned for movement either over (bypassing) or through a selectively operable printing station 20 which includes a first transfer roller 22, a platen roller 24, and a second transfer roller 26 as shown in FIG. 3.

When the selectively operable printing apparatus is in use, the envelope blanks move downwardly around the first transfer roller 22 and over the platen roller 24 (FIG. 3) between the nip of platen roller 24 and a printing roller (not shown) which effects the transfer of the desired indicia onto the envelope blank with the envelope blank then moving up over the second transfer roller 26 and thence back onto the horizontal feed path for movement to a second aligner station 28 and side flap score and fold station 30. When the printing apparatus is not in use, a by-pass bridge 32 is positioned between the first transfer roller 22 and the second transfer roller 26 so that the envelope blanks can move directly to the side flap score and fold station 30 from which the partially completed envelope moves to a position exemplified by the partially completed envelope EI in a side discharge station 34. The partially completed envelopes move from the side discharge station 34 to a bottom flap score and fold station 36 in which the forming of the envelope is completed as exemplified by almost completed envelope EJ with the completed envelopes EK then moving to the envelope delivery station 12 for subsequent discharge from the apparatus.

In the aforementioned conventional apparatus, it is possible to form an open end envelope such as envelope 40 shown in FIG. 2 having an open end flap 42 provided with a layer of contact adhesive 44 over which a release paper patch 46 is applied. Fabrication of an envelope of the foregoing type is accomplished by initially applying a layer 44 of wet contact adhesive to an envelope blank EA in a gumming station 48 at the upstream end of infeed conveyor 14. The adhesive dries slightly during passage of the blank along the length of the conveyor 14 and the blanks move past the work stations 16, 18, 20, 28, and 30 as previously described. It is during this movement that the somewhat wet adhesive presents problems with the operation of the machine as described above. As the partially completed envelopes EH move from the second aligner 28 toward side flap score and fold station 30, the conventional machine applies a release paper patch 46 over the adhesive 44 as the envelope moves into the position of partially completed envelope EH from which it moves through the position EI to the position of partially completed envelope EJ in which the bottom flap is scored and folded. Thus, the envelope blanks in the conventional machine have unprotected wet adhesive 44 exposed for undesired contact with other envelopes or parts of the machine as they move from station 16 to and through station 28. It should be noted that there is no major problem with respect to envelope to envelope contact with the adhesive on the conveyor 14 since the envelopes are spaced apart on the conveyor. However, movement of the blanks from station 16 through station 30 with the adhesive in the exposed position does create substantial problems as has been noted previously.

The present invention, which is illustrated in FIG. 1, largely eliminates the foregoing problems of the conventional apparatus by using the first transfer roller 22 of the printing apparatus in the printing station 20 as a back up for release paper patch applying means provided over the first transfer roller. Consequently, the release paper patch 46 is applied in the present invention to the envelope blank EG in the printing station 20 so that the adhesive is consequently covered and protected from contact with other envelopes and portions of the apparatus as it moves through the second aligner station 28 and score and fold stations 30 and 36.

More specifically, a release paper patch applying apparatus, generally designated 52 is positioned on supporting framework, a portion of which 54 is illustrated in FIG. 3, above the printing station 20. The release paper patch applying apparatus is generally similar to that previously employed in the conventional apparatus between stations 30 and 34 and includes a supply roll 54 of release paper a web of which W is fed downwardly beneath a small feed roll 56, then upwardly over a larger feed roll 58 and downwardly over a tension rod 60 adjacent an apertured vacuum cylinder 62 provided with small openings over its entire periphery and having a laterally extending rotary cutter blade 64 mounted to extend outwardly from its outer periphery. The frame of the machine supports a fixedly positioned blade 66 which is canted approximately one degree with respect to blade 64 and between which blades the web W of release paper passes to effect the severing of the individual release paper patch members 46 from the end of the web with each rotation of the cylinder 62.

The severed patch 46 is held in contact with the vacuum cylinder 62 by virtue of the fact that vacuum from a source 68 applied to a vacuum box 70 communicates with the apertures 63 in that portion of the vacuum cylinder 62 extending downwardly in the direction of rotation of the vacuum cylinder from the area of the fixed blade 66 to the area of a rotary transfer carrier 71. The rotary transfer carrier 71 includes a rotating vacuum foot 72 mounted for rotation about the axis of and with a shaft 74. The rotating vacuum foot 72 is provided with a plurality of openings communicating with an interior chamber connectable by timed valve means to a source of vacuum (not shown).

Figure 4B:
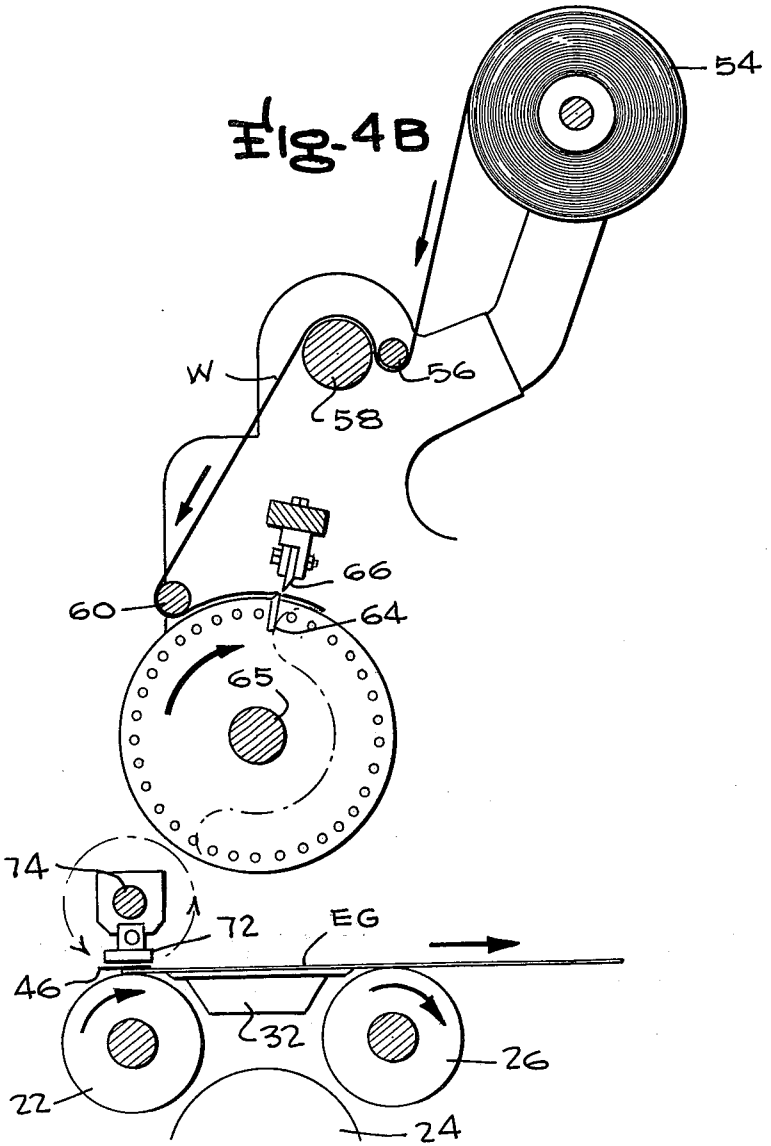
FIG. 4B is a view similar to 4A but illustrating a subsequent step in the application of the release paper patch to the envelope blank.
Figure 4A:
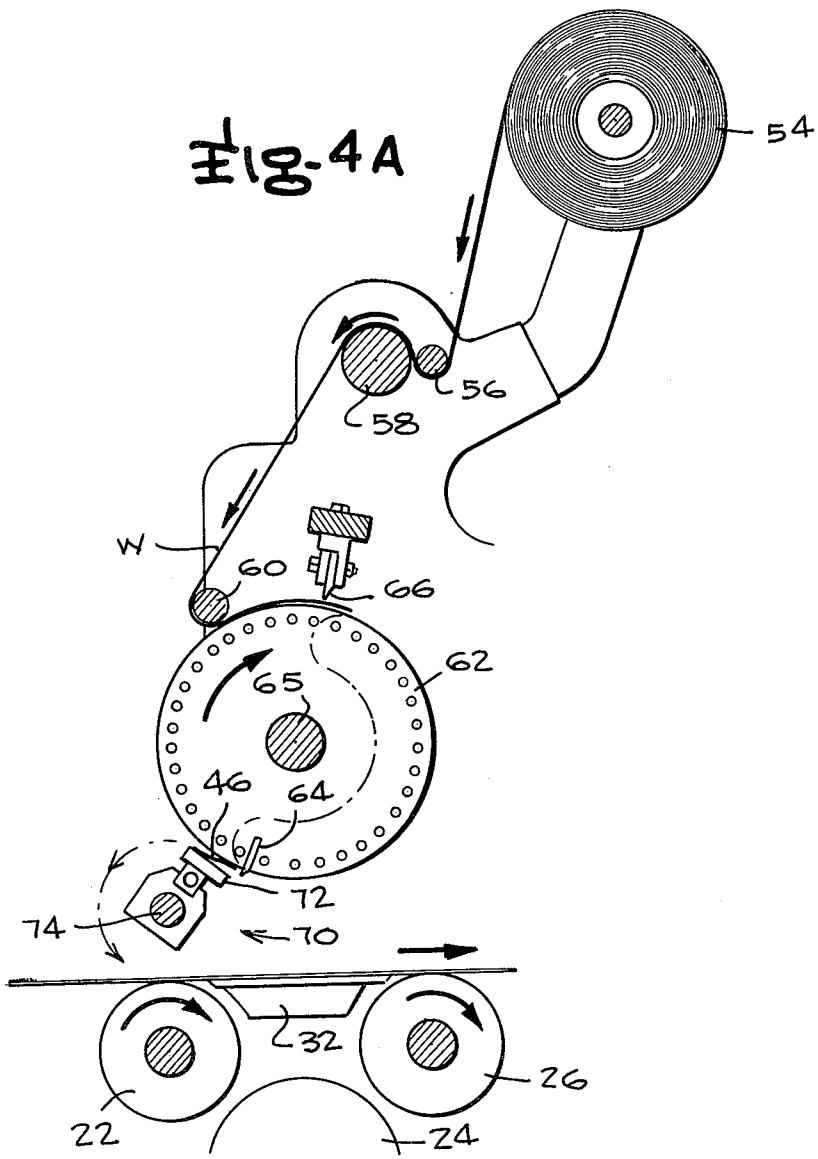
FIG. 4A is a side elevation view of a portion of the release paper patch applying apparatus and the associated printing station apparatus illustrating an initial step in the application of release paper to an envelope blank.

The vacuum is connected to the rotating foot 72 as the rotating foot comes into facing relationship with release paper patch 46 on the periphery of vacuum cylinder 62 as illustrated in FIG. 4A. The vacuum holding the release paper patch 46 on cylinder 62 is terminated to the holes 63 in the outer periphery of the cylinder over which the release paper patch is positioned so that the release paper patch is transferred from cylinder 62 onto the rotating foot 72 which carries the release paper patch around to the position immediately opposite the first transfer roller 22 as shown in FIG. 4B. The vacuum applied to the rotating foot 72 is terminated as the release paper 46 moves into the position shown in FIG. 4B so that the release paper patch 46 is pressed against the adhesive 44 on the upper surface of the end flap of the envelope EF moving through the area immediately above the printing station 20. It should be understood that the shaft 74, shaft 65, rollers 56 and 58 and roller 22 are all driven in synchronization by non-illustrated gearing or the like for maintaining the parts in the necessary relative positions for repetitive application of the release paper patch members to each successive envelope passing through the space between the first transfer roller 22 and the shaft 74.

Thus, the adhesive is covered prior to all scoring and severing operations. Moreover, the transfer roller serves a dual function and would permit a shortening of the overall path of movement of the envelope blanks as compared to the prior known conventional machines.

When is it desired to use the machine for printing, the by-pass bridge is no longer used and the release paper patch applying apparatus 52 is disengaged from the power supply.

Numerous modifications of the disclosed embodiment of the invention will undoubtedly occur to those of skill in the art and it should be understood that the spirit and scope of the invention is consequently to be limited solely by the appended claims.

I claim:

1. In an envelope forming machine of the type including frame means supporting envelope blank feed means for feeding envelope blanks along a feed path from an upstream end serially past aligner means, a printer transfer roller adjacently above selectively operable printer means, scoring means and folding means to an envelope delivery station, the improvement comprising release paper patch applying means positioned adjacent said transfer roller and being operable to apply a patch of release paper to adhesive on a flap of each envelope as each of said envelope flaps passes over said printer transfer roller which serves as a backup roller against the flap during the application of the patch of release paper to the opposite side thereof.

2. The envelope forming machine of claim 1 wherein said release paper patch applying means includes a rotary vacuum cylinder, web feed means for feeding the end of a web of release paper onto said vacuum cylinder, a rotary cutter blade extending along the length of said outer surface of said vacuum cylinder, a fixed blade positioned adjacent the path of travel of the rotary cutter blade so that movement of the rotary cutter blade past the fixed cutter blade severs a release paper patch from the end of the web and rotary transfer means for removing the release paper patch from the vacuum cylinder and applying it to the adhesive on an envelope flap passing over the printer transfer roller.

3. The envelope forming machine of claim 1 wherein said release paper patch applying means includes a rotary vacuum cylinder, web feed means for feeding the end of a web of release paper onto said vacuum cylinder, a rotary cutter blade extending along the length of the outer surface of said vacuum cylinder, a fixed blade positioned adjacent the path of travel of the rotary cutter blade so that movement of the rotary cutter blade past the fixed cutter blade severs a release paper patch from the end of the web and a rotary vacuum foot for removing the release paper patch from the vacuum cylinder and applying it to the adhesive on an envelope flap passing over the printer transfer roller.

4. The envelope forming machine of claim 1 wherein said release paper patch applying means includes a rotary vacuum cylinder, web feed means for feeding the end of a web of release paper onto said vacuum cylinder, a rotary cutter blade extending along the length of the outer surface of said vacuum cylinder, a fixed blade positioned adjacent the path of travel of the rotary cutter blade so that movement of the rotary cutter blade past the fixed cutter blade severs a release paper patch from the end of the web and a rotary vacuum foot mounted on a shaft above and parallel to the axis of the transfer roller for removing the release paper patch from the vacuum cylinder and applying it to the adhesive on an envelope flap passing over the printer transfer roller.

5. The envelope forming machine of claim 1 wherein said transfer roller is the upstream one of two transfer rollers and wherein said release paper patch applying means includes a rotary vacuum cylinder, web feed means for feeding the end of a web of release paper onto said vacuum cylinder, a rotary cutter blade extending along the length of the outer surface of said vacuum cylinder, a fixed blade positioned adjacent the path of travel of the rotary cutter blade so that movement of the rotary cutter blade past the fixed cutter blade severs a release paper patch from the end of the web and a rotary vacuum foot mounted on a shaft above and parallel to the axis of the transfer roller for removing the release paper patch from the vacuum cylinder and applying it to the adhesive on an envelope flap passing over the printer transfer roller.

6. An envelope forming machine including conveyor means for feeding envelope blanks past a plurality of work stations including a printing station, said printing station including a selectively operable transfer roller for feeding envelope blanks relative to a platen roller and release paper patch applying means positioned adjacent said conveyor means and facing said transfer roller to apply a patch of release paper to adhesive on each of said envelope blanks as each envelope blank passes over the transfer roller which serves as a back-up roller against the portion of the envelope blank onto which the release paper patch is applied.

7. An envelope forming machine as recited in claim 6 wherein said transfer roller is positioned beneath and adjacent said conveyor means and feeds envelope blanks to said platen roller when said priting station is in operation.

* * * * *